US009376171B1

(12) United States Patent
Bagwell

(10) Patent No.: US 9,376,171 B1
(45) Date of Patent: Jun. 28, 2016

(54) MOORING CLEAT WITH OPEN DESIGN FOR NON-THREADED ENTRY

(71) Applicant: Brandon R. Bagwell, Chesapeake, VA (US)

(72) Inventor: Brandon R. Bagwell, Chesapeake, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 49 days.

(21) Appl. No.: 14/107,019

(22) Filed: Dec. 16, 2013

(51) Int. Cl.
*B63B 21/04* (2006.01)

(52) U.S. Cl.
CPC ..... *B63B 21/04* (2013.01); *B63B 21/045* (2013.01)

(58) Field of Classification Search
CPC ..... B63B 21/04; B63B 21/10; B63B 21/045; B63B 21/00; B63B 21/06; F16G 11/00; E02B 3/24
USPC ..... 114/218; D8/356
See application file for complete search history.

(56) References Cited

U.S. PATENT DOCUMENTS

| | | | | | |
|---|---|---|---|---|---|
| 557,984 | A | * | 4/1896 | Foran | 114/218 |
| 816,827 | A | * | 4/1906 | Skene | 114/101 |
| D191,885 | S | * | 12/1961 | Corlett | D8/356 |
| 3,126,858 | A | | 3/1964 | Rosinski | |
| 4,683,831 | A | | 8/1987 | Shaffner | |
| 4,763,595 | A | | 8/1988 | Shaffner | |
| 5,477,800 | A | * | 12/1995 | Lawrence | 114/218 |
| 5,878,684 | A | | 3/1999 | Adams | |
| 6,409,230 | B1 | | 6/2002 | Entenmann | |
| 7,464,443 | B2 | | 12/2008 | Lopes Praca | |
| 8,430,048 | B2 | | 4/2013 | Tamulewicz et al. | |

* cited by examiner

*Primary Examiner* — Andrew Polay
(74) *Attorney, Agent, or Firm* — Dave A. Ghatt

(57) ABSTRACT

A mooring cleat with open design for restraining a line and for attaching a free end of the line, the mooring cleat having an overlapping horn design with an angled slot that allows a line/rope into the device at any desired position along the line, wherein the cleat restrains the line against static pull in nearly any three-dimensional direction.

10 Claims, 4 Drawing Sheets

MOORING CLEAT WITH OPEN DESIGN FOR NON-THREADED ENTRY

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a mooring cleat with open design for restraining a line and for attaching a free end of the line, the mooring cleat having an overlapping horn design with an angled slot that allows a line/rope into the device at any desired position along the line, wherein the cleat restrains the line against static pull in nearly any three-dimensional direction.

BACKGROUND

Mooring fittings can be fabricated from many different materials and may take many different forms. These fittings guide and secure lines/ropes for vessels during different types of operations, such as mooring, anchoring, towing, rafting, and servicing etc. FIG. 1A is a prior art illustration of known mooring chock devices 10, 12, and 14. Chock devices are typically used as feed-through devices for lines which are then fed to another device for fixed attachment. Chock 10 for example, includes a closed loop hole through which a line is threaded. Depending on the length of the line, this process can be time consuming. Chocks 12 and 14 each includes an opening that allows any part of the line to be placed within the restraint area, so that the entire line does not have to be threaded through the device, thereby saving time. However, with designs similar to chock 12, the line may escape the device when there is vertical movement via the opening 13. The chock 14 embodiment, which includes a slanted opening 15 (shown clearly in the top view section of FIG. 1A) is successful at preventing the line from escaping in the vertical direction.

FIG. 1B is a prior art illustration of known mooring cleat devices 20, 22, 24, and 26. Cleats as illustrated are used to terminate/secure the end of a line. For example, a line with a free end may be tied and secured around cleats 20 and 22. Cleats 24 and 26 are structured to have an opening allowing a line to be threaded through opening in the fitting and secured to the device. The opening in the fitting to allow a line to be fed through the fitting allowing it to be used as a fairlead with the line being terminated at another location. This requires the operator to take the unattached end of the line and feed it through the fitting before attaching at the termination point. This can be difficult and time consuming if a long line is used. This situation causes safety concerns, particularly when high loads or the relative movement of vessels is involved. It is most often desirable to attach the line as quickly as possible.

While chock fittings are available and can be used for restraining in the vertical direction, there is a need for a device that accomplishes both the attachment of the free/bitter end and restraint of the line without the need to feed the line through. The installation of multiple fittings increases the complexity and cost associated with deck fittings. Installing both cleats and chocks precludes installation of a single fitting in an optimum location, such as on centerlines or amidships.

SUMMARY

In one aspect, the invention is a mooring cleat with open design for restraining a line/rope and for attaching a free end of the line/rope. The mooring cleat has an elongated base plate, and a first horn extending vertically from the elongated base plate. The first horn has a first substantially cylindrical bottom portion extending vertically from the elongated base, and a first elongated top portion attached to the first substantially cylindrical bottom portion. The first elongated top portion has a front end and a rear end, and the first elongated top portion extends parallel to a longitudinal axis X. The mooring cleat also includes a second horn extending vertically from the elongated base plate, the second horn having a second substantially cylindrical bottom portion extending vertically from the elongated base. The second elongated top portion is attached to the second substantially cylindrical bottom portion, the second elongated top portion having a front end and a rear end. The second elongated top portion extends parallel to the longitudinal axis X, wherein the first elongated top portion and the second elongated top portion extend towards each other so that respective front ends of the first elongated top portion and the second elongated top portion overlap in a non-contacting manner, having an angled slot therebetween.

In another aspect, the invention is a boat having a hull body with a gunwale. In this aspect, the boat also includes a mooring cleat with open design for restraining a line and for attaching a free end of the line. The mooring cleat is attached at the gunwale. The mooring cleat has an elongated base plate, and a first horn extending vertically from the elongated base plate. The first horn has a first substantially cylindrical bottom portion extending vertically from the elongated base, and a first elongated top portion attached to the first substantially cylindrical bottom portion. The first elongated top portion has a front end and a rear end, and the first elongated top portion extends parallel to a longitudinal axis X. The mooring cleat also includes a second horn extending vertically from the elongated base plate, the second horn having a second substantially cylindrical bottom portion extending vertically from the elongated base. The second elongated top portion is attached to the second substantially cylindrical bottom portion, the second elongated top portion having a front end and a rear end. The second elongated top portion extends parallel to the longitudinal axis X, wherein the first elongated top portion and the second elongated top portion extend towards each other so that respective front ends of the first elongated top portion and the second elongated top portion overlap in a non-contacting manner, having an angled slot therebetween

BRIEF DESCRIPTION OF THE DRAWINGS

Other features will be apparent from the description, the drawings, and the claims.

DETAILED DESCRIPTION

Figure 1A:
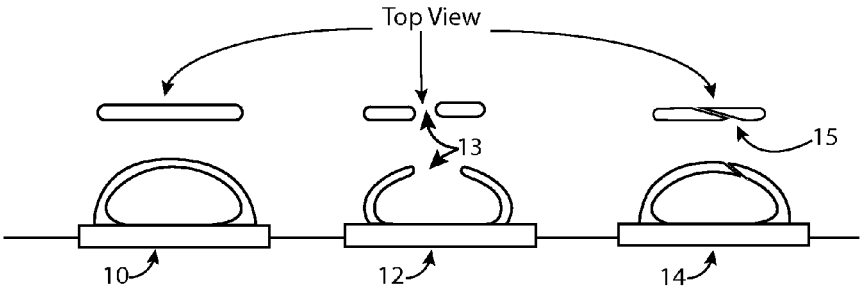
Figure 1A (Prior Art)
FIG. 1A is a prior art illustration of known mooring chocks.
Figure 2:
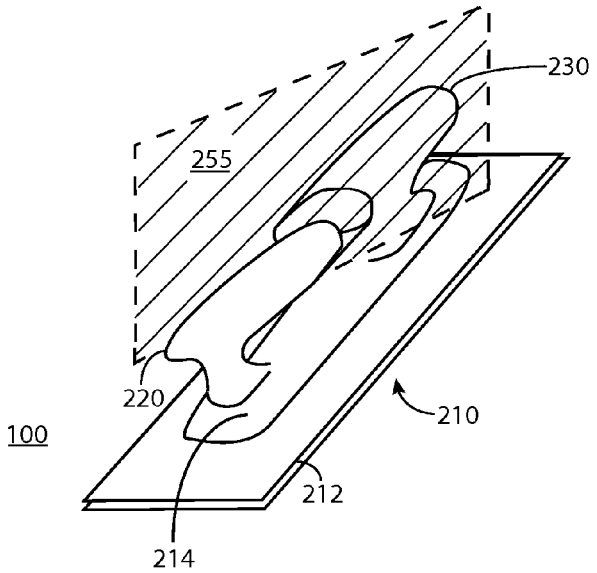
FIG. 2 is an exemplary perspective view of a mooring cleat with open design for restraining a line and for attaching a free end of the line, according to an embodiment of the invention.

FIG. 2 is an exemplary perspective view of a mooring cleat 100 with open design for restraining a line and for attaching a free/bitter end of the line, according to an embodiment of the invention. The mooring cleat 100 is a single fitting that has the ability to function both as a cleat for terminating a regular or eye spliced line, or as an overlapping open chock (as shown in FIG. 1A). As shown the cleat 100 includes an elongated base plate 210. The cleat 100 also includes a first horn 220 extending vertically from the elongated base plate 210, and a second horn 230, also extending vertically from the elongated base plate 210. The first and second horns 220 and 230 facilitate the attachment of the free/bitter end of lines. FIG. 2 also shows a gap 250 between the first horn 220 and the second horn 230. As shown the gap 250 is an angled slot angled in the plane 255. As outlined below, the angled slot 250 is the element of the open design which allows a line to be place through the angled slot 250, as opposed to threading an entire line through the cleat 100. The slot 250 is only large enough to permit a suitably sized line to slide through to an opening within cleat 100. The mooring cleat 100 may be fabricated using various processes, from materials such as steel, aluminum, bronze, brass, or combinations thereof. As shown, all edges are smoothed and rounded for reduced internal stress concentration and improved line life.

Figure 3C:
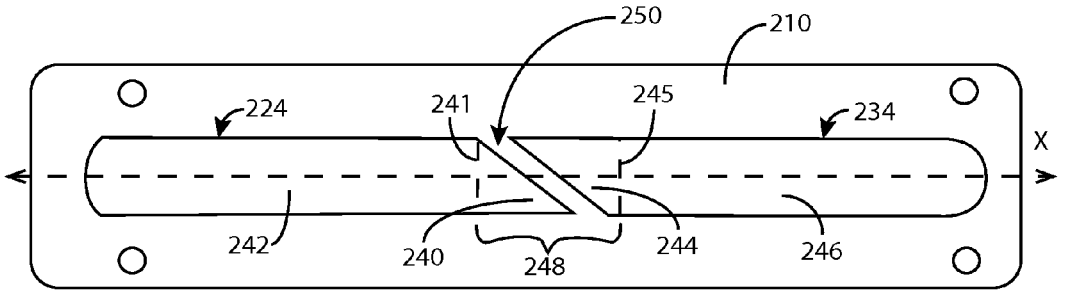
FIG. 3C is an exemplary top view of a mooring cleat with open design for restraining a line and for attaching a free end of the line, according to an embodiment of the invention.
Figure 3A:
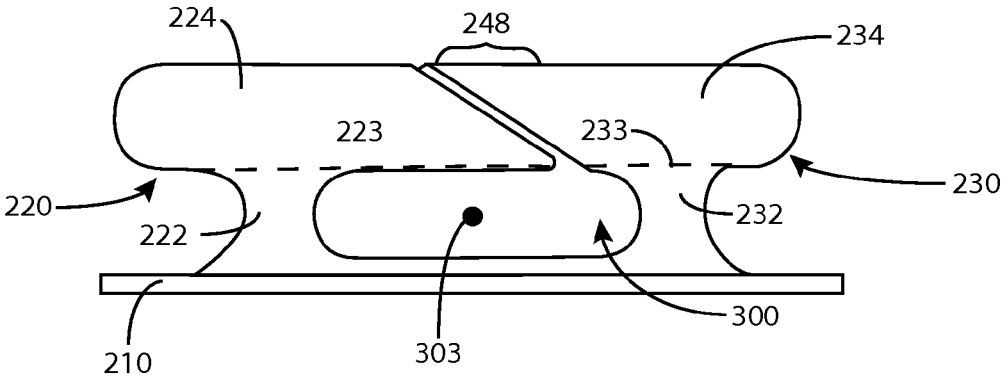
FIG. 3A is an exemplary top view of a mooring cleat with open design for restraining a line and for attaching a free end of the line, according to an embodiment of the invention.

FIG. 3A is an exemplary side view of a mooring cleat 100 with open design for restraining a line and for attaching a free end of the line, according to an embodiment of the invention. FIG. 3A shows the elements outlined above, including the elongated base plate 210, the first horn 220 which extends vertically from the elongated base plate 210, and the second horn 230, which also extends vertically from the elongated base plate 210. As shown the first horn 220 has a first substantially cylindrical bottom portion 222. Also shown is a first elongated top portion 224 attached to and above the first substantially cylindrical bottom portion 222. The first and second substantially cylindrical bottom portions (222, 232) are shaped to facilitate the attachment of the bitter end of a line. FIG. 3A shows these portions separated by imaginary line 223. As shown the second horn 230 has a second substantially cylindrical bottom portion 232, and a second elongated top portion 234 attached to and above the first substantially cylindrical bottom portion 222. FIG. 3A shows these portions separated by imaginary line 233. As shown, each of the first and second horn (220, 230) is substantially T-shaped.

Returning to FIG. 2, according to an embodiment of the invention, the elongated base plate 210 may be multilayered. The base plate 210 may have a first substantially planar layer 212 and a second layer 214 above the first substantially planar layer. The second layer 214 may be attached to the first layer 212 by known attachment means or methods, such as by brazing, soldering, adhesive bonding, diffusion bonding, thermal bonding, or the like, or by using mechanical agents such as bolts, screws, or the like. As shown, the second layer 214 may be integrally formed with each of the first substantially cylindrical bottom portion 222 and the second substantially bottom cylindrical portion 232.

Figure 3B:
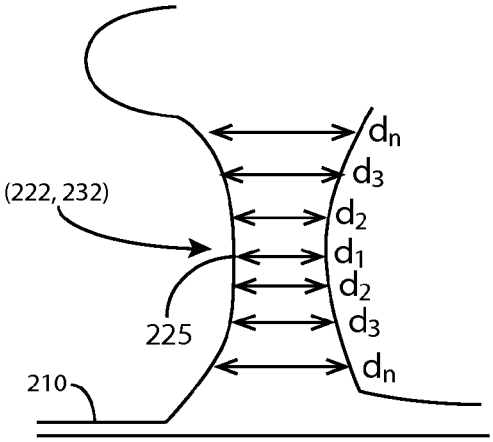
FIG. 3B is an exemplary magnified view of the substantially cylindrical bottom portions of the horns, according to an embodiment of the invention.

FIG. 3B is an exemplary magnified view of the substantially cylindrical bottom portions (222, 232) of the horns (220,230) shown in FIG. 3A, according to an embodiment of the invention. As shown, the first and second substantially cylindrical bottom portions (222, 232) have varying diameters ($d_1$, $d_2$, $d_3$, . . . $d_n$), with a smallest diameter $d_1$, at a central portion 225 and larger diameters ($d_2$, $d_3$, . . . $d_n$) progressing upwards and downwards from the central portion 225. Thus, the substantially cylindrical bottom portions (222, 232) have an outer surface that is substantially concave in shape. It is understood that by "substantially cylindrical" the bottom portions (222, 232) have substantially circular cross sections. However, the bottom portions (222, 232) may have another rounded shape such as an oval or elliptical shape, which also facilities the attachment of the bitter end of a line.

FIG. 3C is an exemplary top view of a mooring cleat 100 with open design for restraining a line and for attaching a free end of the line, according to an embodiment of the invention. FIG. 3C shows the elongated base plate 210, as well as the first and second elongated top portions of the (224, 234) of the respective first and second horns (220, 230). As shown, the first elongated top portion 224 has a front end 240 having a triangular shape, and a rear end 242. FIG. 3C shows the front end 240 and the rear end 242 separated by imaginary line 241. Also shown is the second elongated top portion 234 having a front end 244 having a triangular shape, and a rear end 246. FIG. 3C shows the front end 244 and the rear end 246 separated by imaginary line 245.

Figure 1B:
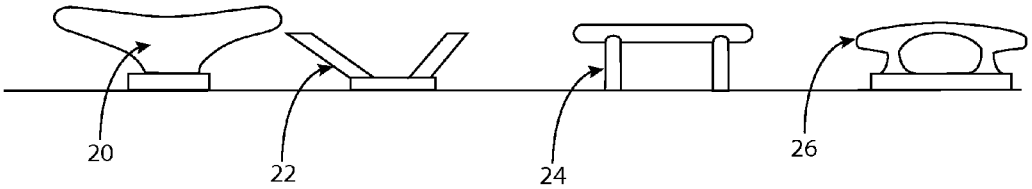
Figure 1B (Prior Art)
FIG. 1B is a prior art illustration of known mooring cleats.

FIG. 3C shows the elongated top portions (224, 234) extending along and parallel to an elongation axis X. As shown, the elongated top portions (224, 234) extend so that the respective front ends 240 and 244 overlap in overlap region 248. Because of the triangular shape of the front ends 240 and 244, a gap/angular slot 250 is formed between the non-contacting front ends 240 and 244. In manufacturing the cleat 100, the angular slot 250 may be formed by originally having the first and second top portions (224, 234) as a single element (similar to cleats 24 and 26 of the FIG. 1B), from which a rectangular chunk is cut, using known cutting devices such as a or the like. This forms the angular slot 250 and leaves the front ends (240, 244) with a triangular shape. Alternatively, the elongated top portions (224, 234) may be manufactured as separate elements having respective front ends 240 and 244 that overlap. As stated above, the mooring cleat elements may be fabricated using various processes, from materials such as steel, aluminum, bronze, brass, or combinations thereof.

Figure 3D:
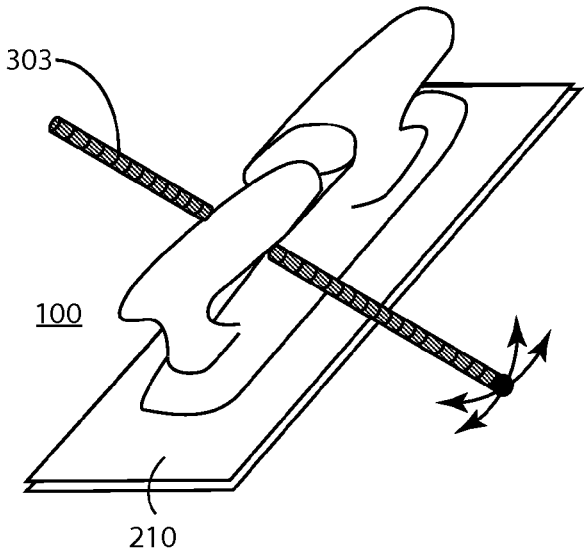
FIG. 3D is a perspective illustration, showing a line within the opening of the mooring cleat, according to an embodiment of the invention.

Returning to the side view illustration of FIG. 3A, as shown, the cleat 100 includes an opening 300, which may be used as a fairlead. As seen from the side view, the combination of the substantially concave shape of the first and second substantially cylindrical bottom portions (222, 232), the elongated base plate 210, and the overlapping first and second elongated top portions (224, 234), produces the opening 300, which from the side view is a closed loop opening. Essentially, the closed loop side view is the view seen by a line 303 threaded into the opening 300. As shown, the line 303 is oriented so that it is directed into the page, perpendicular to the surface of the page. FIG. 3D is a perspective illustration, showing the line 303 within the opening 300, which because of the overlapping top portions (224, 234) is essentially a closed loop with respect to the orientation of line 303. Thus, the overlapping horn design allows a line in the orientation of line 303, passing thorough the cleat 100 to be restrained against a static pull in nearly any three-dimensional direction. It should be noted that the only way for a line to be released is if the source of tension follows an arc in a vertical plane that is in alignment with the slot 250 between the horns, which would allow the line to escape.

Figure 4A:
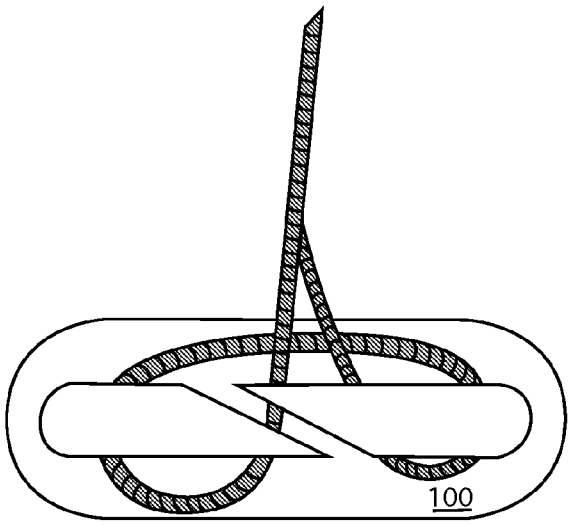
FIG. 4A is an exemplary perspective illustration of a mooring cleat with open design with a line threaded therein and terminated, according to an embodiment of the invention.
Figure 4B:
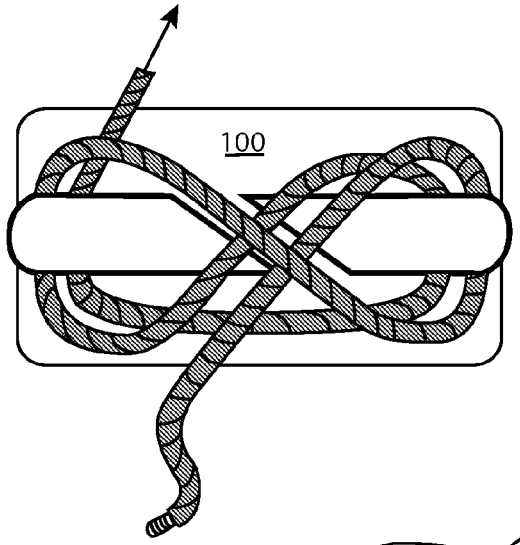
FIG. 4B is an exemplary perspective illustration of a mooring cleat with open design with a line threaded therein and terminated, according to an embodiment of the invention.

FIGS. 4A and 4B are exemplary perspective illustrations of a mooring cleat with open design with a line received therein and terminated, according to an embodiment of the invention. As outlined above, prior art chock fittings are available and can be used for restraining in the vertical direction, there is a need for a device that accomplishes both the attachment of the free/bitter end and restraint of the line without the need to feed the line through. FIGS. 4A and 4B show the mooring cleat 100 performing the functions of restraint and attachment. FIG. 4A shows the cleat 100 attaching a free end and restraining a line in a terminated eye splice configuration. FIG. 4B shows the cleat 100 attaching a free end and restraining a line with the bitter end terminated with a first layer wrapped across the slot 250. Because of the slot 250, the lines shown in FIGS. 4A and 4B do not have to be threaded through the device 100 from a bitter end of a line, but may be slipped into the device 100 via the slot 250 at any desired location along the line.

Figure 5:
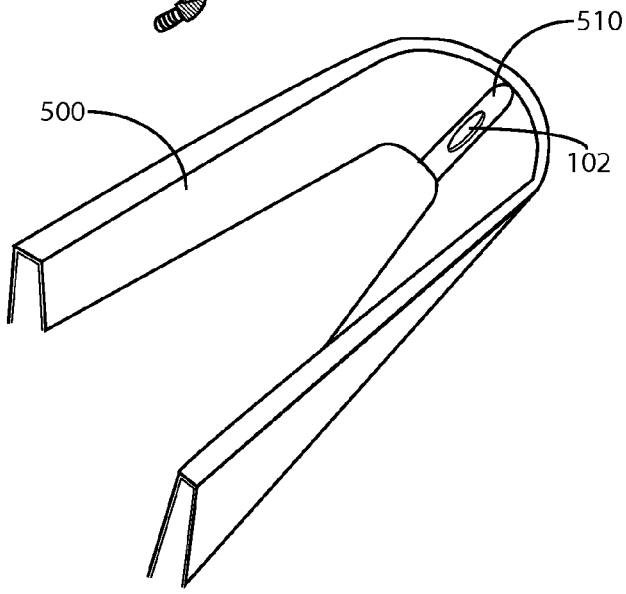
FIG. 5 is an exemplary illustration of a boat hull including a mooring cleat with an open design for restraining a line and for attaching a free end of the line, according to an embodiment of the invention.

FIG. 5 is an exemplary illustration of a boat having a hull 500 including a mooring cleat 100, according to an embodiment of the invention. FIG. 5 shows a gunwale 510 to which the mooring cleat 100 is attached. The combination of chocking features with line terminating features allows less total fittings to be installed on the hull 500, with equivalent or increased functionality, and increased flexibility. The mooring cleat 100 may be bolted at the gunwale 510 so the attachment is strong enough to withstand working loads. Although bolting a preferred means of attaching the cleat 100 at the gunwale 510, other attachment means may be employed, such as screwing, or soldering, brazing, adhesion bonding, or the like, or combinations thereof. The mooring cleat 100 allows routine mooring activities, including the attachment of the free/bitter end of a line and restraint of the line therewithin, without the need to thread the line through the opening 300, but by slipping the desired part of the line through the slot 250.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A mooring cleat with open design for restraining a line and for attaching a free end of the line, the mooring cleat consisting:

an elongated base plate;

a first horn extending vertically from the elongated base plate, the first horn consisting:

a first substantially cylindrical bottom portion extending vertically from the elongated base; and a first elongated top portion attached to the first substantially cylindrical bottom portion, the first elongated top portion having a front end and a rear end, the first elongated top portion extending parallel to a longitudinal axis X;

a second horn extending vertically from the elongated base plate, the second horn consisting:

a second substantially cylindrical bottom portion extending vertically from the elongated base; and a second elongated top portion attached to the second substantially cylindrical bottom portion, the second elongated top portion having a front end and a rear end, the second elongated top portion extending parallel to said longitudinal axis X, wherein the first elongated top portion and the second elongated top portion extend towards each other so that respective front ends of the first elongated top portion and the second elongated top portion overlap in a non-contacting manner, having an angled slot therebetween.

2. The mooring cleat of claim 1, wherein the front ends of each of the first elongated top portion and the second elongated top portion have a triangular shape, and wherein said longitudinal axis X is central to each of the first elongated top portion and the second elongated top portion, and wherein the triangular shaped front portions overlap producing said angled slot between the front ends of the first elongated top portion and the second elongated top portion.

3. The mooring cleat of claim 2, wherein each of the first and second substantially cylindrical bottom portions has varying diameters, with a smallest diameter at a central portion and larger diameters progressing upwards and downwards from the central portion, so that each of the of the first and second substantially cylindrical bottom portions have an outer surface that is substantially concave in shape, and wherein from a side view, the combination of the substantially concave shape of the first and second substantially cylindrical bottom portions, the elongated base plate, and the overlapping first and second elongated top portions, produces a closed loop opening therethrough.

4. The mooring cleat of claim 3, wherein the elongated base plate comprises;

a first substantially planar layer, and a second layer above the first substantially planar layer, wherein the second layer is integrally formed with each of the first substantially cylindrical bottom portion and the second substantially bottom cylindrical portion of the respective first and second horn.

5. The mooring cleat of claim 4, wherein the rear ends of each the first and second elongated top portions extend along the longitudinal axis X in a direction opposite to that of the respective front end, so that along with the respective first and second substantially cylindrical bottom portions, each of the first and second horn is substantially T-shaped.

6. A boat comprising:

a hull body having a gunwale;

a mooring cleat with open design for restraining a line and for attaching a free end of the line, wherein the mooring cleat is attached at the gunwale, the mooring cleat consisting:

an elongated base plate;

a first horn extending vertically from the elongated base plate, the first horn consisting:

a first substantially cylindrical bottom portion extending vertically from the elongated base; and a first elongated top portion attached to the first substantially cylindrical bottom portion, the first elongated top portion having a front end and a rear end, the first elongated top portion extending parallel to a longitudinal axis X;

a second horn extending vertically from the elongated base plate, the second horn consisting:

a second substantially cylindrical bottom portion extending vertically from the elongated base; and a second elongated top portion attached to the second substantially cylindrical bottom portion, the second elongated top portion having a front end and a rear end, the second elongated top portion extending parallel to said longitudinal axis X, wherein the first elongated top portion and the second elongated top portion extend towards each other so that respective front ends of the first elongated top portion and the second elongated top portion overlap in a non-contacting manner, having an angled slot therebetween.

7. The boat of claim 6, wherein the front ends of each of the first elongated top portion and the second elongated top portion of the mooring cleat has a triangular shape, and wherein said longitudinal axis X is central to each of the first elongated top portion and the second elongated top portion, and wherein the triangular shaped front portions overlap producing said angled slot between the front ends of the first elongated top portion and the second elongated top portion.

8. The boat of claim 7, wherein each of the first and second substantially cylindrical bottom portions has varying diameters, with a smallest diameter at a central portion and larger diameters progressing upwards and downwards from the central portion, so that each of the of the first and second substantially cylindrical bottom portions have an outer surface that is substantially concave in shape, and wherein from a side view, the combination of the substantially concave shape of the first and second substantially cylindrical bottom portions, the elongated base plate, and the overlapping first and second elongated top portions, produces a closed loop opening therethrough.

9. The boat of claim 8, wherein the elongated base plate of the mooring cleat comprises;

a first substantially planar layer; and a second layer above the first substantially planar layer, wherein the second layer is integrally formed with each of the first substantially cylindrical bottom portion and the second substantially bottom cylindrical portion of the respective first and second horn.

10. The boat of claim 9, wherein the rear ends of each the first and second elongated top portions extend along the longitudinal axis X in a direction opposite to that of the respective front end, so that along with the respective first and second substantially cylindrical bottom portions, each of the first and second horn is substantially T-shaped.

* * * * *